United States Patent [19]

Vandament

[11] 4,159,681

[45] * Jul. 3, 1979

[54] REINFORCED, LIGHT-WEIGHT PALLET

[76] Inventor: Daniel D. Vandament, 527 Fairview Ave., Mill Valley, Calif. 94941

[ * ] Notice: The portion of the term of this patent subsequent to Oct. 4, 1994, has been disclaimed.

[21] Appl. No.: 838,728

[22] Filed: Oct. 3, 1977

[51] Int. Cl.[2] ..... B65D 19/26

[52] U.S. Cl. ..... 108/51.1; 52/309.7; 108/901

[58] Field of Search ..... 108/51.1, 57.1, 901, 108/902, 51.3, 52.1, 53.1, 53.3, 55.1-56.3; 52/309.7, 615, 222; 248/346; 206/386, 595-600; 428/174, 320, 322

[56] References Cited

U.S. PATENT DOCUMENTS

| | | | |
|---|---|---|---|
| 3,603,273 | 9/1971 | Riffe | 108/51.1 |
| 3,719,157 | 3/1973 | Arcocha et al. | 108/51.1 |
| 3,778,949 | 12/1973 | Hellerich | 52/309.7 |
| 3,814,778 | 6/1974 | Hosoda et al. | 108/901 X |
| 3,880,092 | 4/1975 | Seeber et al. | 108/51.1 |
| 4,051,833 | 10/1977 | Vandament | 52/615 X |

FOREIGN PATENT DOCUMENTS

| | | | |
|---|---|---|---|
| 1144715 | 3/1969 | United Kingdom | 108/51.3 |

*Primary Examiner*—Roy D. Frazier
*Assistant Examiner*—William E. Lyddane
*Attorney, Agent, or Firm*—Fitch, Even & Tabin

[57] ABSTRACT

A strong, light-weight pallet adapted for use with a fork lift or the like includes a flexible arched member arranged between upper and lower sheet members and secured in place by means of an adhesive insulating material such as structural grade polyurethane foam, the ends of the flexible arched member being fixed or restrained relative to the lower sheet member. The arched member is effectively rigidized by the adhesive material to act as a load carrying member. Means for engaging elongated tines of a fork lift or similar load carrying elements are formed beneath the ends of the arched member so that a load carried upon the pallet is transferred to the tines substantially through the arched member.

10 Claims, 4 Drawing Figures

REINFORCED, LIGHT-WEIGHT PALLET

BACKGROUND OF THE INVENTION

The present invention relates to a light-weight, load carrying pallet and more particularly to such a pallet including an arched member which is maintained in its arched configuration by adhesive foam material to provide structural rigidity within the pallet.

Large numbers of such pallets are employed in warehouse operations and the like. Commonly, substantial loads are placed upon the pallets which are adapted to be carried by elongated tines of a fork lift for example. For this purpose, pallets are commonly fabricated from wood as a generally elongated flat box structure upon which the load may be arranged. The tines of the fork lift may penetrate within the boxed structure in order to move the pallet and the load arranged thereupon. Such pallets tend to be relatively heavy and awkward to handle. Accordingly, there has been found to remain a need for a strong, light-weight pallet adapted for use in warehousing operations and the like.

SUMMARY OF THE INVENTION

It is therefor an object of the present invention to provide a strong, light-weight pallet including a flexible member which is secured in an arched configuration by means of adhesive foam material such as polyurethane foam in order to facilitate rapid manufacture of a large number of pallets which are very light-weight and which are reinforced by the arched member in order to carry substantial loads.

The pallet preferably comprises upper and lower sheet members with a flexible member formed into an arch therebetween, its ends being secured adjacent the ends of the lower sheet member, the flexible member being effectively rigidized by the foam material in order to support substantial loads upon the upper surface of the pallet. Means for receiving load carrying elements such as the tines of a fork lift truck are arranged in spaced apart relation adjacent the ends of the arched member so that a load carried upon the upper surface of the pallet is supported and transferred substantially by the arched member.

A number of advantages are provided by the pallet of the present invention. Initially, the pallet may be extremely light-weight while being reinforced by the arched member in order to carry substantial loads. In addition, minimum storage space is required since the pallets may be assembled in large numbers as required. Prior to assembly, the relatively thin upper and lower sheet members as well as the flexible arched member may be stored in minimum space along with components for the adhesive foam. During assembly, it is only necessary to arrange the arched member between the upper and lower sheet members and to inject the foam. Brackets or the like for receiving tines of a fork lift may be integrally formed as a part of the lower sheet member or may be secured thereto either before or after injection of foam into the pallet.

In addition, the present invention permits a relatively thin, light-weight pallet to be employed for storing loads in warehouses or the like in order to minimize the amount of space required for storage.

Additional objects and advantages of the invention are made apparent in the following description having reference to the accompanying drawings.

DESCRIPTION OF THE PREFERRED EMBODIMENTS

Figure 1:
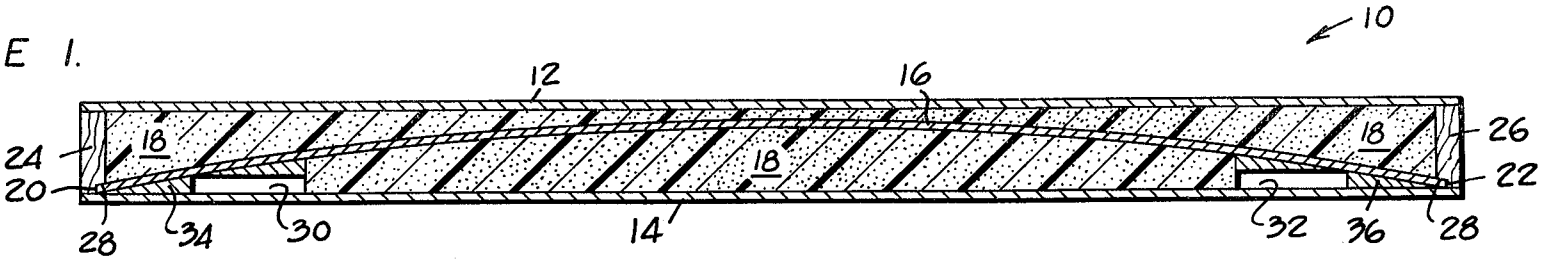
FIG. 1 is a vertically sectioned view of a pallet constructed in accordance with the present invention.
Figure 2:
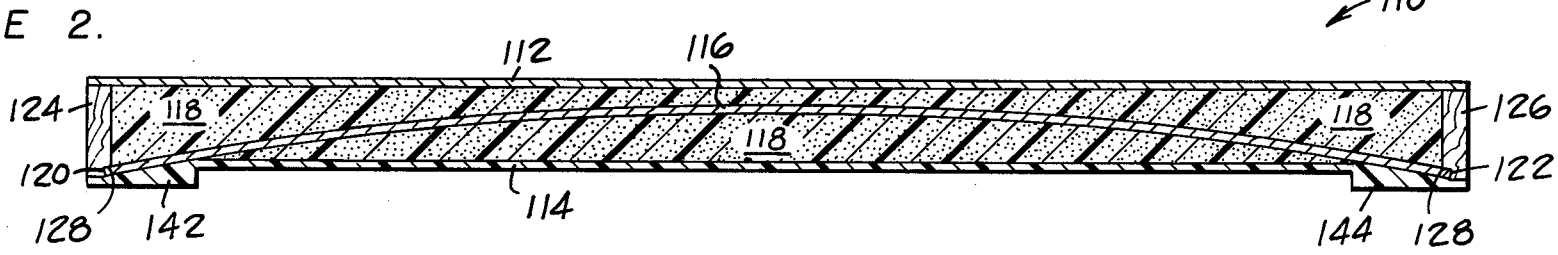
FIGS. 2, 3 & 4 are similar views of additional embodiments of a pallet also constructed in accordance with the present invention.
Figure 3:
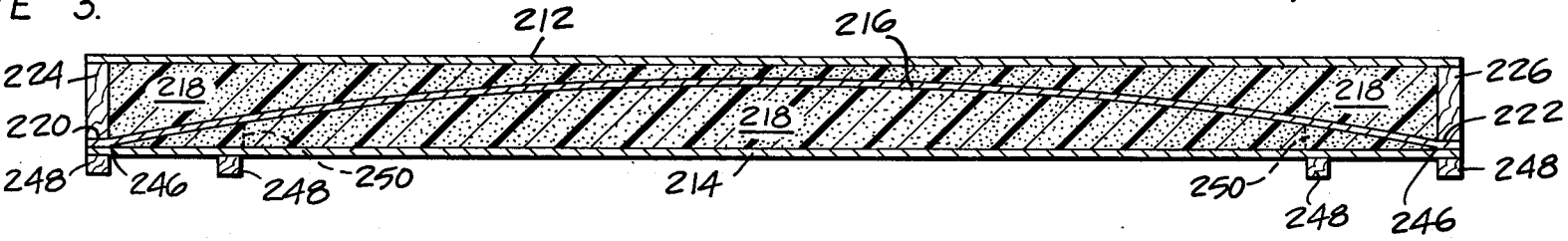

Each of the embodiments in the FIGS. 1–3 illustrates a pallet including upper and lower sheet members, the upper sheet member being adapted to receive a load, means being formed by or arranged adjacent the lower sheet member for transferring weight to load carrying elements such as spaced apart tines of a fork lift truck. Structural strength for the upper and lower sheet members is provided by an arched member which is initially flexible and is maintained and rigidized in its arched configuration between the sheet members by means of an adhesive foam such as structural grade polyurethane foam for example. In this manner, a heavy load carried upon the pallet is transferred to the tines or load carrying elements substantially through the rigidized arched member.

Referring now to FIG. 1, a pallet according to the present invention is indicated at 10 and includes upper and lower sheet members 12 and 14. The sheet members have substantially the same surface dimensions as the pallet, conventionally four feet by four feet. The upper sheet member 12 may be of a generally tough material adapted for receiving various materials of the type conventionally stored and/or transported upon pallets.

Structural integrity and load carrying capacity is provided by means of a flexible, arched member 16 which is arranged between the sheet members 12 and 14. The member 16 is effectively rigidized and maintained in place between the sheet members by means of adhesive foam material generally indicated at 18. The foam 18 intimately contacts all surfaces of the arched member as well as the inner surfaces of the upper and lower sheet members 12 and 14, the foam acting primarily in compression to maintain spacing between the arched member 16 and each of the sheet members 12 and 14.

The lateral ends 20 and 22 are preferably secured or fixed relative to the lower sheet member 14. This may be accomplished in a number of different ways, as is better described below. The lateral ends of the pallets may be closed by means of blocks such as those indicated at 24 and 26. The blocks may be employed to provide a protective enclosure for the foam as well as to assist in securing the ends of the arched member 16 in order to better maintain its arched configuration particularly during construction or assembly of the pallet.

As may be seen in FIG. 1, the lower edge of the end blocks 24 and 26 is notched, as indicated at 28, to receive adjacent end 20 or 22 of the arched member. With the member 16 in its arched configuration, the upper and lower sheet members may then be secured to end blocks, for example by nails, in order to maintain the member 16 in its arched configuration while the adhesive foam is being injected thereabout.

As indicated above, the pallet 10 is preferably adapted to be used with elongated load carrying elements such as spaced apart tines of a fork lift truck (not shown). With a load being carried upon the upper surface of the pallet, it is particularly important that the load be effectively transferred through the pallet to the fork lift tines. Means for receiving the tines are arranged adjacent the ends of the arched member 16 and are preferably structurally connected with the arched member so that the load carried upon the pallet is transferred to the tines substantially through the member 16. For this purpose, elongated openings 30 and 32 for receiving the fork lift tines are formed by shaped structural spacers 34 and 36 which are secured both in the lower sheet member 14 and the arched member 16 adjacent its ends 20 and 22. It may be seen from FIG. 1 that the spacers 34 and 36 provide a solid interconnection between the tines and the arched member.

In order to effectively rigidize the entire arched member 16, it is spaced apart from the upper sheet member 12 along its entire length. In this manner, the foam 18 is in intimate contact with the entire upper surface of the arched member as well as the entire exposed lower surface thereof.

Both the upper and lower sheet members 12 and 14 as well as the arched member 16 may be formed for example from relatively thin plywood which by itself would not have any substantial load carrying capacity. However, with injection of foam between such panels of plywood in an arrangement taught by the present invention, a strong yet light-weight pallet may be readily formed from those components.

Another embodiment of the pallet is illustrated in FIG. 2. Many of the components in FIG. 2 correspond with the components in the embodiment of FIG. 1. Accordingly, the pallet in FIG. 2 is generally indicated at 110 and has components identified by numerical labels corresponding to those of FIG. 1 while being preceded by the additional numeral "1". The primary difference between the embodiments in FIGS. 1 and 2 is the manner in which openings are formed to receive the tines of a fork lift truck. In FIG. 2, the lower sheet member 114 integrally includes shaped spacer means 142 and 144 adjacent the ends 120 and 122 of the arched member 116. The entire portion of the lower sheet member 114 between the spacer means 142 and 144 is recessed in order to provide means for receiving the tines of the fork lift truck. Otherwise, the pallet of FIG. 2 is formed and functions in substantially the same manner as described above for the embodiment of FIG. 1.

Another embodiment of the pallet is indicated at 210 in FIG. 3. Here again, similar numerical labels are employed for the various components while being preceded by the additional numeral "2". In the embodiment of FIG. 3, the ends 220 and 222 of the arched member 216 extend entirely beneath the end blocks 224 and 226. In order to initially form the member 216 in this configuration, it may be scored at 246 adjacent each end portion 220 and 222 in order to form the arched portion of the member 216 while allowing its ends to lie flat beneath the end blocks 224 and 226. The lower sheet member 214 extends across the entire dimension of the pallet. Spacer elements 248 are secured to the lower sheet member 214 in order to effectively form the opening 230 and 232 for receiving the tines of the fork lift. Here again, shaped spacers as indicated in broken lines at 250 may optionally be employed to assure proper transfer of the weight of a load between the upper surface of the pallet and the fork lift tines through the arched member 216.

Figure 4:
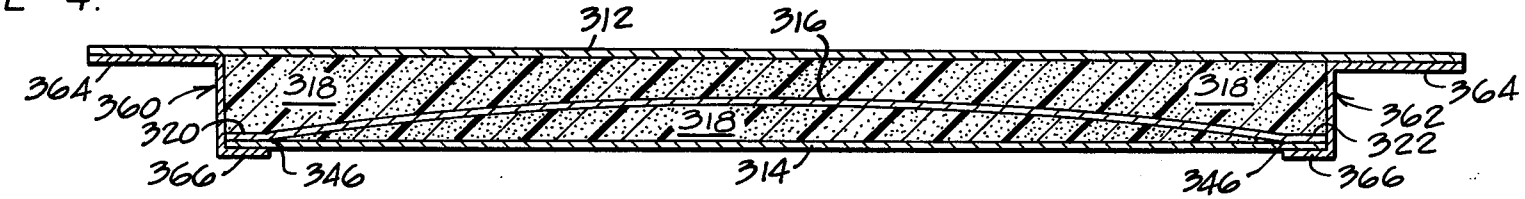

FIG. 4 illustrates yet another embodiment of the pallet, as indicated at 310, similar numerical labels being employed for the various components of the pallet while being preceeded by the additional numeral "3". The embodiment of FIG. 4 differs from that of FIG. 3 primarily in that the overall length of the arched member 316 is foreshortened and the end blocks 224 and 226 are replaced by Z-shaped brackets 360 and 362.

Each of the brackets 360 and 362 includes an upper horizontal leg 364 underlying a lateral end portion of the upper sheet member 312. Similarly, each of the brackets 360 and 362 also includes a lower horizontal leg 366 extending inwardly beneath the respective lateral edges of the lower sheet member 314 and the horizontal ends 320 and 322 of the arched member 316.

The brackets 360 and 362 are formed from a structural material such as steel, for example. The fork lift tines engage the pallet 310 beneath the upper legs 364 of the two brackets. The structural form of the bracket permits the load carried upon the pallet and received by the arched member to be transferred through the brackets 360 and 362 to the tines of the fork lift.

Within the configuration of FIG. 4 and the contemplated mode of operation, the lower sheet member 314 continues to serve the same function of providing a tensioning element between the ends of the arched member 316 as well as between the lower legs 366 of the brackets 360 and 362. It will be apparent from FIG. 4 that the lower sheet member 314 could also be formed as an integral extension of the lower bracket legs 366.

The arched member 316 is preferably scored at 346 so that its lateral ends 320 and 322 are arranged parallel with the lower legs 366 of the brackets to assure an intimate and strong interconnection therebetween. Each end of the arched member may be secured to the respective end of the lower sheet member 314 and the respective lower bracket leg 366 for example by glue, metal fasteners or the like. The upper bracket legs 364 may be similarly secured to the lateral ends of the upper sheet member 312.

Additional variations and modifications of a pallet according to the present invention are believed apparent from the preceding description. Accordingly the scope of the present invention is defined only by the following appended claims.

What is claimed is:

1. A light-weight, load carrying pallet, adapted for use with a fork lift or the like, comprising a reinforced pallet structure having an upper sheet member and a lower sheet member with a flexible member arranged in the form of an arch there between and secured at its ends to the lower sheet member, adhesive foam material intimately contacting both sides of the flexible arched member and the inner surfaces of the sheet members to completely fill the spaces between the flexible arched member and the sheet members and to effectively rigidize and maintain the arched member in its arched configuration, and recess forming means arranged in longitudinally spaced apart relation adjacent the lower sheet member to receive elongated load carrying tines of a fork lift, the spaced apart recess forming means being structurally interconnected with the ends of the arched member in order to transfer the weight of a load carried upon the upper sheet to the load carrying tines substantially through the arched member.

2. The pallet of claim 1 wherein the adhesive foam material is a polymeric foam.

3. The pallet of claim 1 wherein the adhesive foam is a structural grade polyurethane foam.

4. The pallet of claim 1 further comprising end blocks being secured to end portions of the lower sheet member and overlapping adjacent ends of the flexible arched member.

5. The pallet of claim 1 further comprising structural spacers arranged intermediate the adjacent ends of the arched member and the lower sheet member to form elongated openings for receiving load carrying elements such as tines of a fork lift truck.

6. The pallet of claim 1 wherein the lower-sheet member is recessed to form openings for receiving elongated load carrying elements such as tines of a fork lift truck.

7. The pallet of claim 1 further comprising end blocks secured to end portions of the lower sheet member, end portions of the arched member being formed to extend beneath the adjacent end blocks.

8. The pallet of claim 1 further comprising spacer means secured to the outer surface of the lower sheet member to form elongated openings for receiving load carrying elements such as tines of a fork lift truck.

9. The pallet of claim 1 wherein lateral edges of the upper sheet member overlap respective lateral edges of said lower sheet member and further comprising a Z-shaped bracket along each lateral edge of the pallet, each bracket including an upper horizontal leg underlying and secured to a respective lateral edge of said upper sheet member and means for securing each bracket to a respective end of said arched member in order to transfer a load supported on said upper sheet member through said arched member to said upper horizontal bracket legs.

10. The pallet of claim 1 further comprising Z-shaped brackets arranged respectively along lateral edges of the pallet, each bracket including an upper horizontal leg portion for engagement with the load carrying tines and means for engaging a respective end of said arched member to transfer a load supported upon said upper sheet member through said arched member to the upper bracket legs.

* * * * *